US005377878A

United States Patent [19]

Rainey et al.

[11] Patent Number: 5,377,878

[45] Date of Patent: Jan. 3, 1995

[54] CONTAINER SUPPORTING AND DISPENSING APPARATUS

[76] Inventors: Donald S. Rainey; Sharon R. Rainey, both of 1117 Judith Cove, Memphis, Tenn. 38018

[21] Appl. No.: 151,005

[22] Filed: Nov. 12, 1993

[51] Int. Cl.[6] ..... B67D 5/62

[52] U.S. Cl. ..... 222/146.6; 222/185; 222/401; 62/376

[58] Field of Search ..... 222/146.6, 185, 401; 62/376

[56] References Cited

U.S. PATENT DOCUMENTS

| | | | |
|---|---|---|---|
| 718,163 | 1/1903 | Sherrard | 222/401 X |
| 1,017,756 | 2/1912 | Head | 222/185 X |
| 1,019,416 | 3/1912 | Bonnell | 222/185 X |
| 1,125,450 | 1/1915 | Bonnell | 222/185 X |
| 1,319,376 | 10/1919 | Cooper | 222/185 X |
| 1,336,172 | 4/1920 | Tripp | 62/376 |
| 2,713,248 | 7/1955 | Cann, Sr. et al. | 62/376 X |
| 3,814,293 | 6/1974 | Daves | 222/185 X |
| 4,664,297 | 5/1987 | Giovinazzi | 222/185 |
| 4,715,516 | 12/1987 | Salvail | 222/185 X |
| 4,722,463 | 2/1988 | Anderson | 222/185 |

*Primary Examiner*—Andres Kashnikow
*Assistant Examiner*—Kenneth Bomberg
*Attorney, Agent, or Firm*—Michael J. Colitz, Jr.

[57] ABSTRACT

A container supporting and dispensing apparatus for supporting a bottle in a sloped position and dispensing the contents of the bottle through a valve. The device includes a valve assembly which may be threadably coupled to an associated bottle. The valve assembly can then be secured to a container support which positions the bottle in a sloped position to facilitate gravity assisted dispensing through the valve assembly. An alternate embodiment of the present invention includes a pump assembly for re-pressurizing the bottle after use. A further alternate embodiment includes both an ice tray for containing ice within the container support and a water circulation assembly for collecting chilled water from the ice tray and cascading the chilled water over the associated bottle to provide a cooling effect to the contents of the bottle.

2 Claims, 4 Drawing Sheets

CONTAINER SUPPORTING AND DISPENSING APPARATUS

BACKGROUND OF THE INVENTION

1. Field of the Invention

The present invention relates to dispensers and more particularly pertains to a container supporting and dispensing apparatus for supporting a bottle in a sloped position and dispensing the contents of the bottle through a valve.

2. Description of the Prior Art

The use of dispensers is known in the prior art. More specifically, dispensers heretofore devised and utilized for the purpose of dispensing liquids are known to consist basically of familiar, expected and obvious structural configurations, notwithstanding the myriad of designs encompassed by the crowded prior art which have been developed for the fulfillment of countless objectives and requirements.

For example, a pouring spout and carbonation retention apparatus is illustrated in U.S. Pat. No. 5,180,081 which may be utilized for selectively dispensing a variable or fixed portion of gas-containing liquid from a container. A removable vessel is including for maintaining a charge of gas and is mounted within the housing, a spout of the type conventionally used for the dispensing of liquids is integral with the housing and extends outwardly therefrom, and a handle is pivotally attached to the top of the housing to be movable in respect to the housing. Movement of the handle will cause a variable or fixed charge of gas to enter the container for dispersion into the liquid in the container.

A base type dispenser for bottle like containers with collapsible dispensing and vent lines is described in U.S. Pat. No. 4,186,848 which is particularly adapted for receiving large sized beverage containers for the purpose of dispensing partial quantities thereof. The dispenser includes a spigot which is of a simulated construction and generally corresponds to soda fountain dispenser spigots of the past. The dispenser may have incorporated therein a scale which is operable by the weight of the container and the beverage contained therein to indicate the amount of beverage remaining in the container when the beverage can not be visually inspected.

Another patent of interest is U.S. Pat. No. 5,022,565 which discloses a soft drink dispenser for fastening to a conventional carbonated beverage container and for providing the convenient dispensing of the contents therein while maintaining the carbonation of the beverage until fully consumed. The dispenser is comprised of a body assembly containing a tube assembly for extending from the bottom of the beverage within the container to the dispenser outlet, with a valve mechanism spring loaded to squeeze the tube closed and manually operable for controllably allowing the flow of the beverage therethrough. The body assembly further includes a unique pressure regulator and a CO2 cartridge in a cartridge holder fox providing a source of CO2 at the regulated pressure to the beverage container.

While these devices fulfill their respective, particular objectives and requirements, the aforementioned patents do not disclose a container supporting and dispensing apparatus for supporting a bottle in a sloped position and dispensing the contents of the bottle through a valve. Furthermore, none of the known prior art dispensers teach or suggest a container supporting and dispensing apparatus which includes both a manual pump assembly for re-pressurizing the bottle after use and an ice tray for containing ice having a water circulation assembly for collecting chilled water from the ice tray and cascading the chilled water over the associated bottle to provide a cooling effect to the contents of the bottle.

In these respects, the container supporting and dispensing apparatus according to the present invention substantially departs from the conventional concepts and designs of the prior art, and in so doing provides an apparatus primarily developed for the purpose of supporting a bottle in a sloped position and dispensing the contents of the bottle through a valve.

SUMMARY OF THE INVENTION

In view of the foregoing disadvantages inherent in the known types of dispenser now present in the prior art, the present invention provides a new container supporting and dispensing apparatus construction wherein the same can be utilized for supporting a bottle in a sloped position and dispensing the contents of the bottle through a valve. As such, the general purpose of the present invention, which will be described subsequently in greater detail, is to provide a new container supporting and dispensing apparatus which has many of the advantages of the dispenser mentioned heretofore and many novel features that result in a container supporting and dispensing apparatus which is not anticipated, rendered obvious, suggested, or even implied by any of the prior art dispenser, either alone or in any combination thereof.

To attain this, the present invention essentially comprises a container supporting and dispensing apparatus for supporting a bottle in a sloped position and dispensing the contents of the bottle through a valve. The device includes a valve assembly which may be threadably coupled to an associated bottle. The valve assembly can then be secured to a container support which positions the bottle in a sloped position to facilitate gravity assisted dispensing through the valve assembly. An alternate embodiment of the present invention includes a pump assembly for re-pressurizing the bottle after use. A further alternate embodiment includes both an ice tray for containing ice within the container support and a water circulation assembly for collecting chilled water from the ice tray and cascading the chilled water over the associated bottle to provide a cooling effect to the contents of the bottle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, thee purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new container supporting and dispensing apparatus which has many of the advantages of the dispenser mentioned heretofore and many novel features that result in a container supporting and dispensing apparatus which is not anticipated, rendered obvious, suggested, or even implied by any of the prior art dispenser, either alone or in any combination thereof.

It is another object of the present invention to provide a new container supporting and dispensing apparatus which may be easily and efficiently manufactured and marketed.

It is a further object of the present invention to provide a new container supporting and dispensing apparatus which is of a durable and reliable construction.

An even further object of the present invention is to provide a new container supporting and dispensing apparatus which is susceptible of a low cost of manufacture with regard to both materials and labor, and which accordingly is then susceptible of low prices of sale to the consuming public, thereby making such container supporting and dispensing apparatus economically available to the buying public.

Still yet another object of the present invention is to provide a new container supporting and dispensing apparatus which provides in the apparatuses and methods of the prior art some of the advantages thereof, while simultaneously overcoming some of the disadvantages normally associated therewith.

Still another object of the present invention is to provide a new container supporting and dispensing apparatus for supporting a bottle in a sloped position and dispensing the contents of the bottle through a valve.

Yet another object of the present invention is to provide a new container supporting and dispensing apparatus including a valve assembly which may be threadably coupled to an associated bottle whereby the valve assembly then can be secured to a container support which positions the bottle in a sloped orientation to facilitate gravity assisted dispensing of the contents of the bottle through the valve assembly.

Even still another object of the present invention is to provide a new container supporting and dispensing apparatus which includes a manually operated pump assembly for re-pressurizing the bottle after use.

Even still yet another object of the present invention is to provide a new container supporting and dispensing apparatus which includes both an ice tray for containing ice within the container support and a water circulation assembly for collecting chilled water from the ice tray and cascading the chilled water over the associated bottle to provide a cooling effect to the contents of the bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
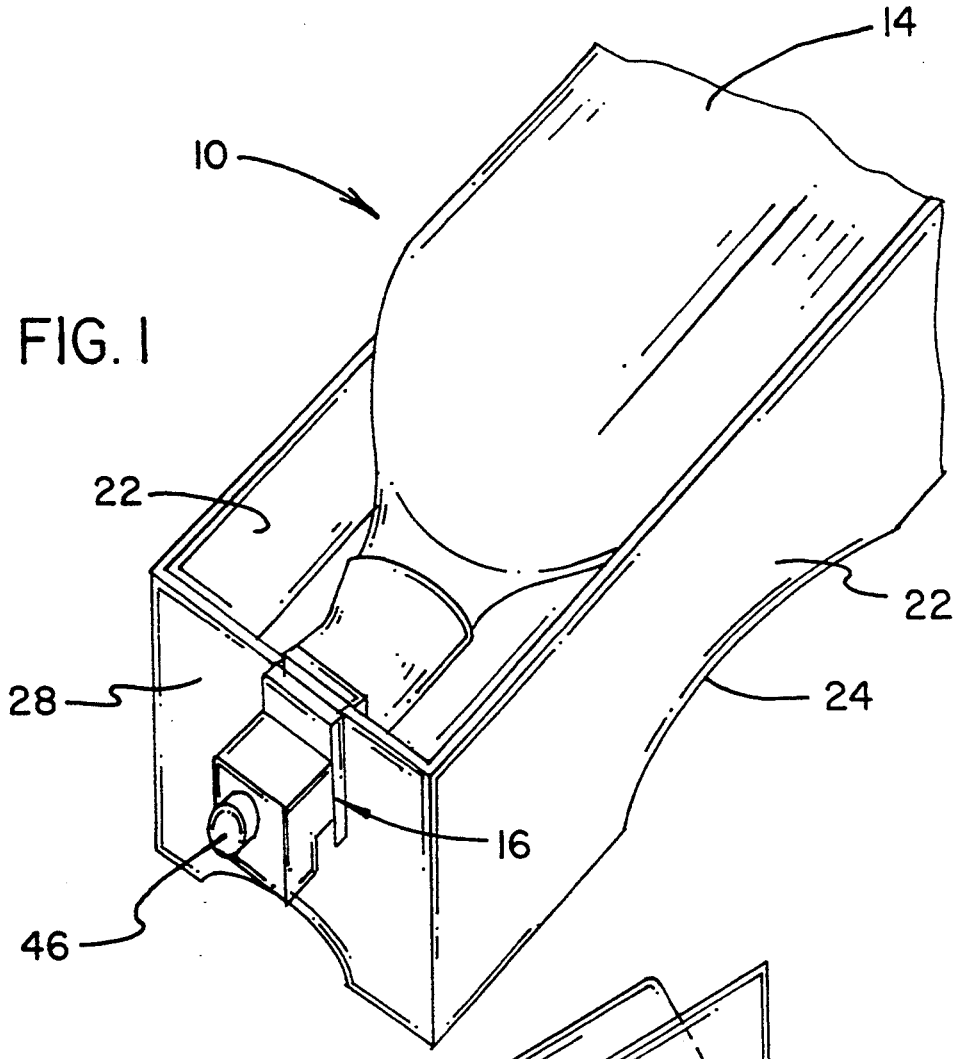
FIG. 1 is a perspective view of a first embodiment of a container supporting and dispensing apparatus comprising the present invention.

With reference now to the drawings, and in particular to FIGS. 1–5 thereof, a first embodiment of a new container supporting and dispensing apparatus embodying the principles and concepts of the present invention and generally designated by the reference numeral 10 will be described.

Figure 3:
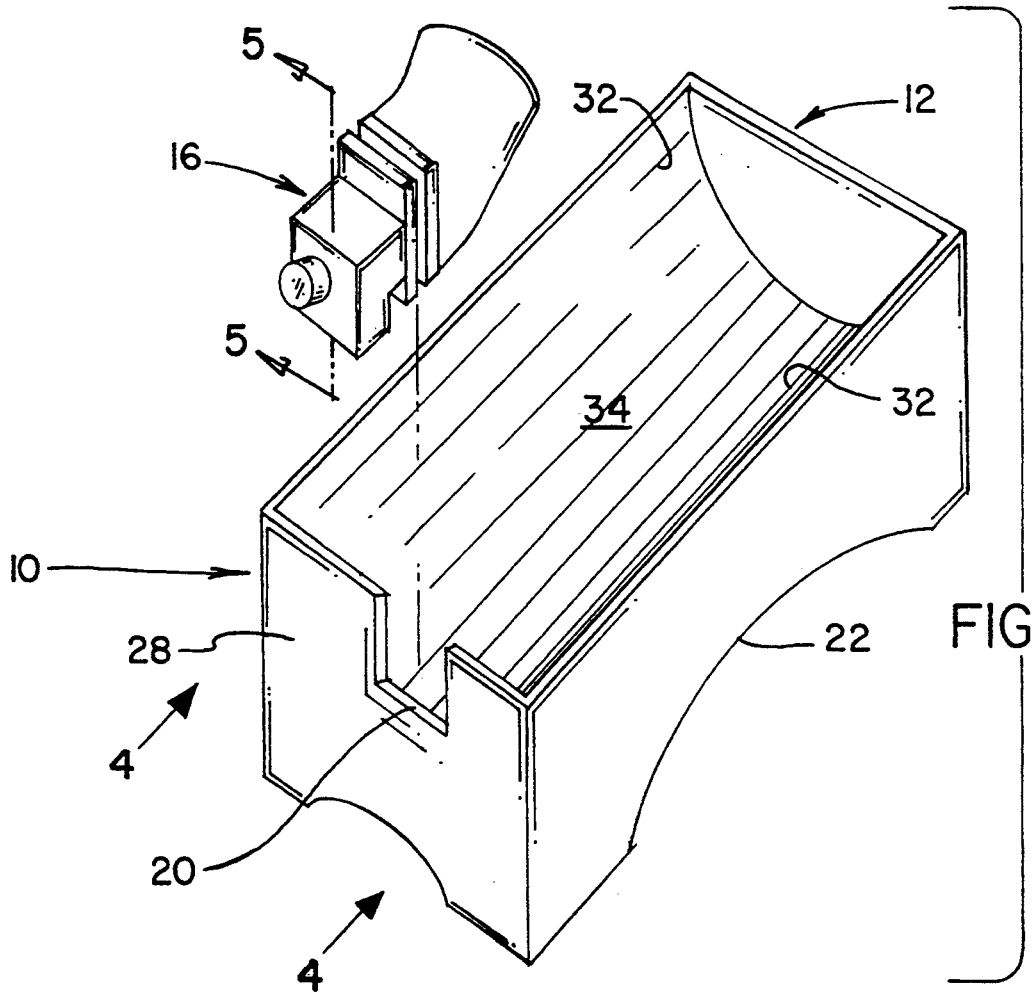
FIG. 3 is a perspective, exploded view of the invention.
Figure 4:
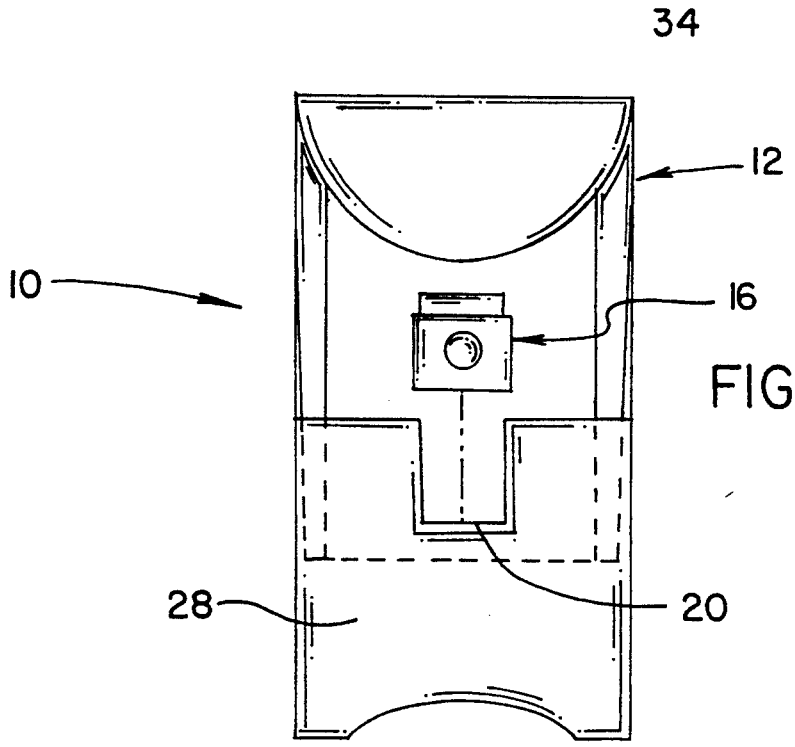
FIG. 4 is a front elevation view, also exploded, of the first embodiment.
Figure 5:
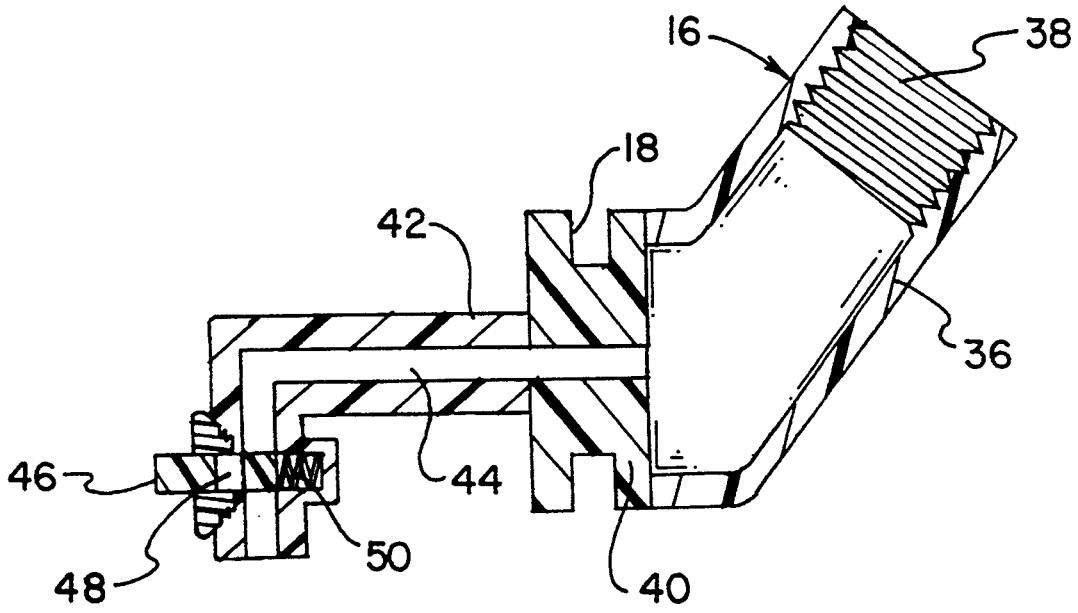
FIG. 5 is a cross sectional view taken along line 5—5 of FIG. 3.

From an overview standpoint, the container supporting and dispensing apparatus 10 comprises a container support 12 operable to receive and support a container 14 in an inclined position with respect to the horizontal. A valve assembly 16 may be threadably coupled to the container 14 in a well understood manner prior to positioning the container upon the container support 12. The valve assembly 16 includes a groove 18, as best illustrated in FIG. 5, which engages a rectangular aperture 20, as best illustrated in FIG. 3, of the container support 12. Such engagement secures the valve assembly 16 and the associated container 14 in an appropriate position upon the container support 12.

In use, the container supporting and dispensing apparatus 10 may be associated with a container 14 such as a soda bottle or the like, whereby the contents of the container may be dispensed through the valve assembly 16 in a convenient manner. Moreover, the container supporting and dispensing apparatus 10 may be placed within a refrigerator or other chilled enclosure such that dispensing of the contents of the container 14 may be accomplished without removing the same from the refrigerator.

Figure 2:
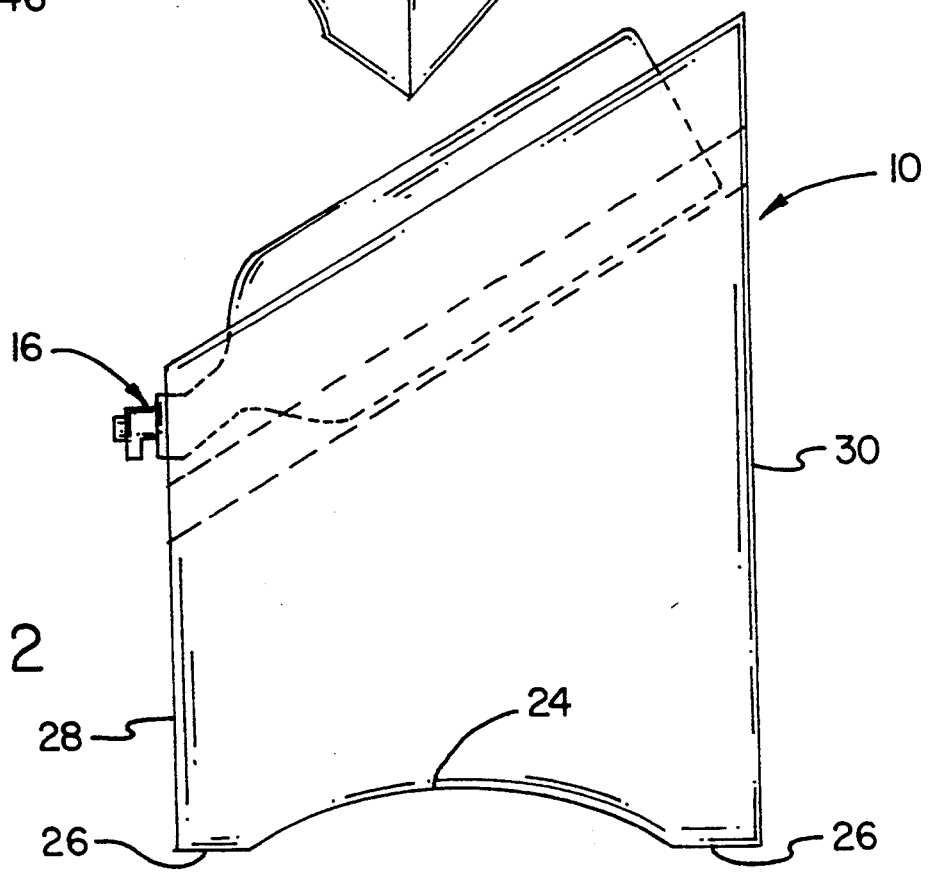
FIG. 2 is a side elevation view of the present invention.

More specifically, it will noted that the container supporting and dispensing apparatus 10 comprises a container support 12 having a pear of similarly shaped side walls 22 in which a cut out 24 is defined at a lower end each thereof. As best illustrated in FIG. 2, the cut out 24 defines a pair of feet 26 which allow the container support 12 to be positioned upon an uneven surface. Integrally or otherwise fixedly secured to front and rear ends of the side walls 22 is a front wall 28 and a rear wall 30, respectively. The front wall 28 includes a rectangular aperture 20 positioned at a top end thereof, as best illustrated in FIG. 3. Also illustrated in FIG. 3 are an arcuately shaped inner wall 32 secured to the side walls 22 to define a cradle 34 operable to support a container positioned thereon.

A valve assembly 16 may be coupled to the container 14 and releasably engaged to the rectangular aperture 20 in the front wall 28 of the container support 12, whereby the contents of the container may be dispensed therefrom. As best illustrated in FIG. 5, the valve assembly 16 comprises a coupling 36 having threads 38 formed on an interior surface thereof which may be threadably engaged to the container 14 in a well interested manner. The coupling 36 is integrally connected to a mount 40 having a groove 18 extending therearound.

A nozzle 42 is integrally connected to the mount 40 and defines an internal passage 44 extending through the mount 40 and positioned in fluid communication with the coupling 36 and the associated bottle 14. The nozzle 42 extends outwardly from the mount 40 and angles downwardly. The unlabeled downwardly extending portion of the nozzle 42 includes a through-extending aperture orientated orthogonally with respect to the internal passage 44 into which a button 46 is slidably positioned. The button 46 includes a through-extending button aperture 48 which may be positioned in alignment with the internal passage 44 to permit fluid communication therethrough. The button 46 is biased into a position which precludes fluid communication through the internal passage 44 by a spring 50. The valve assembly 16 allows the contents of the container 14 to be selectively dispensed through an actuation of the button 46 by a user.

In use, the container supporting and dispensing apparatus 10 may be associated with a container 14 such as a soda bottle or the like, whereby the contents of the container may be dispensed through the valve assembly 16 in a convenient manner. Moreover, the container supporting and dispensing apparatus 10 may be placed within a refrigerator or other chilled enclosure such that dispensing of the contents of the container 14 may be accomplished without removing the same from the refrigerator.

Figure 6:
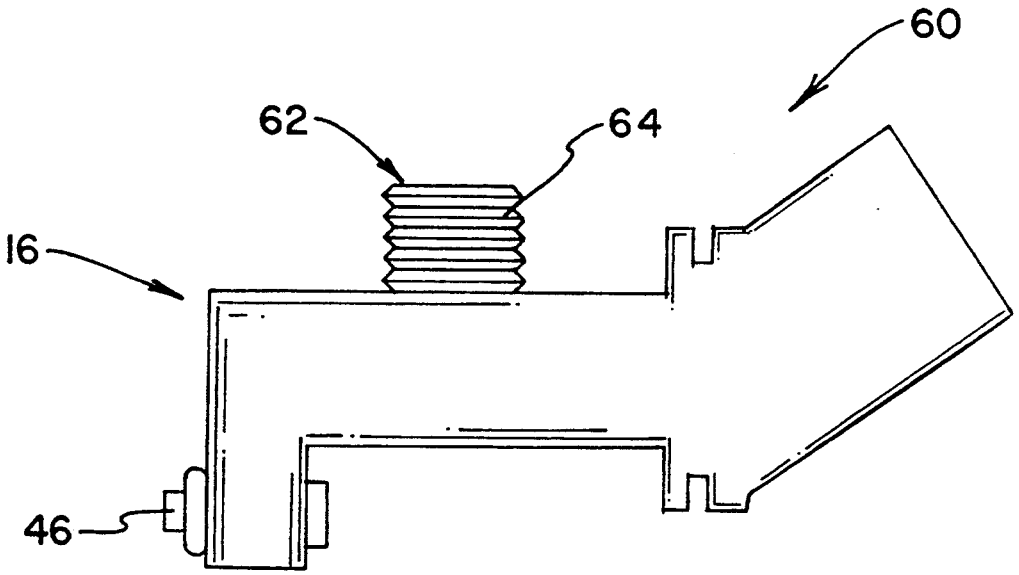
FIG. 6 is an enlarged side elevation view of a portion of a second embodiment of a container supporting and dispensing apparatus comprising the present invention.

A second embodiment of the present invention, as generally designated by the reference numeral 60, which comprises substantially all of the features and structure of the foregoing embodiment 10 and which further comprises a pump assembly 62 will now be described. As best shown in FIG. 6, it can be shown that the pump assembly 62 comprises an accordion-style pump 64 coupled to the valve assembly 16 and operable to inject air into the internal passage 44, thereby pressurizing the container 14. The accordion pump 64 is positioned between the coupling 36 and the dispensing button 46 and includes appropriate, conventionally known one-way valves which preclude an entrance of the contents of the container 14 into the pump 64. The accordion pump 64 is of a conventional design and, therefore, will not be described in detail.

In use, the second embodiment allows a user to repressurize the container 14, thereby retaining carbonated beverages under a pressure which precludes the dissolved carbon dioxide from coming out of solution.

Figure 7:
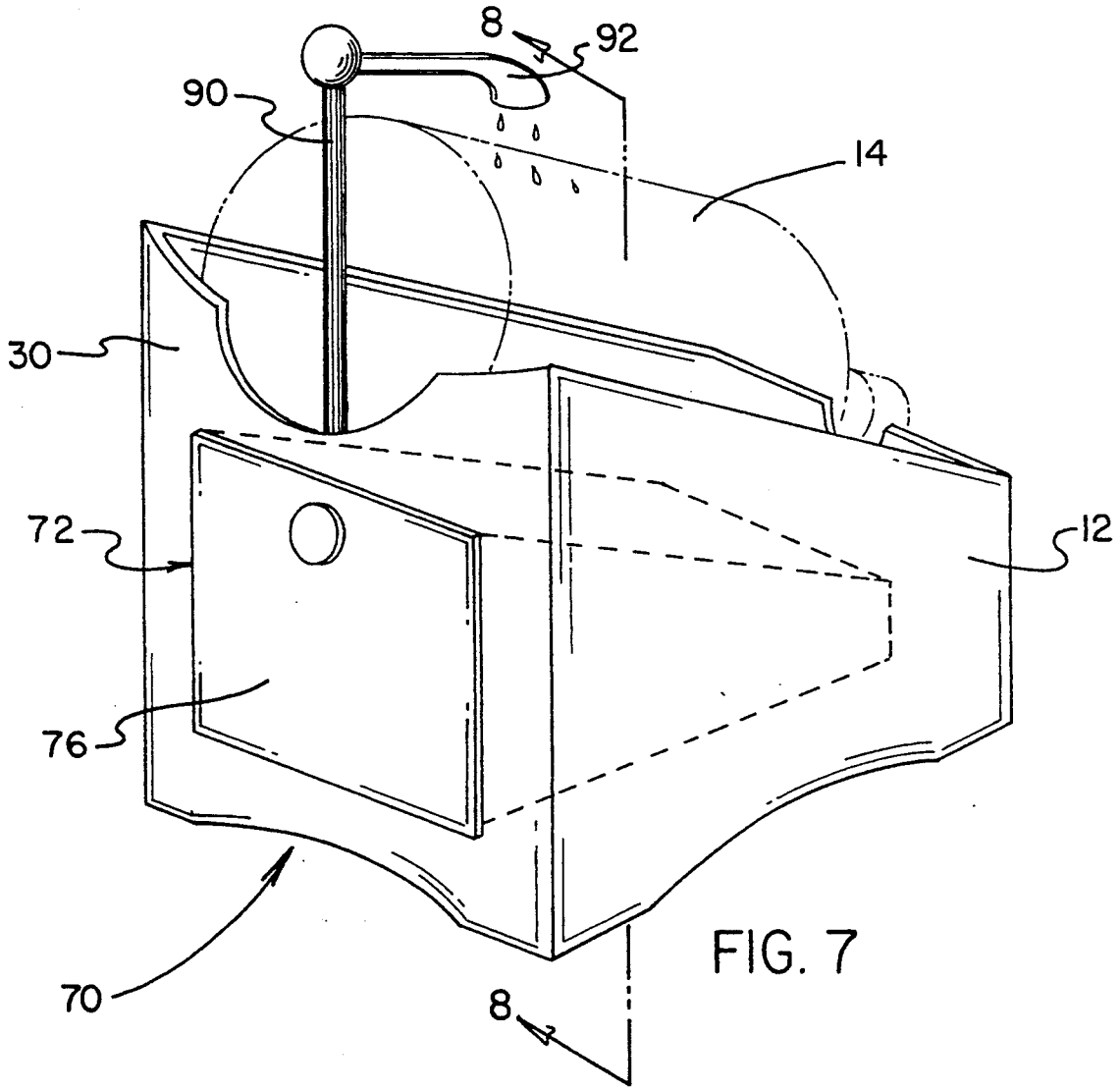
FIG. 7 is a perspective view of a third embodiment of a container supporting and dispensing apparatus comprising the present invention.
Figure 8:
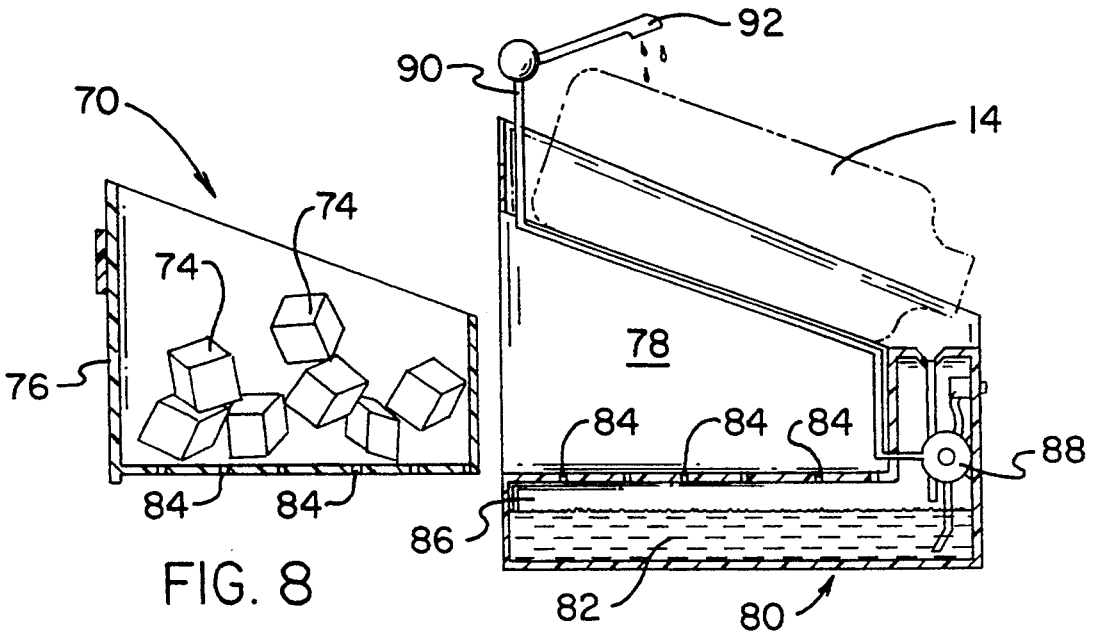
FIG. 8 is a cross sectional view of the third embodiment taken along line 8—8 of FIG. 7.

Comprising substantially all of the features and structure of the previous embodiments 10, 60 is a third embodiment which is generally designated by the reference numeral 70 and may be viewed in FIGS. 7–8. With reference to these Figures, it can be shown that the third embodiment 70 further comprises an ice container assembly 72 operable to releasably contain ice 74 within the container support 12. The ice container assembly 72 comprises a tray 76 slidably disposed in a cavity 78. The cavity 78 is integrally formed within the container support 12 and is positioned beneath the cradle 34, as best illustrated in FIG. 8. The ice container assembly 72 allows ice 74 to be conveniently carried within the container support 12.

In addition, the third embodiment 70 may be provided with a water circulation assembly 80 which collects chilled water 82 from the ice 74 which has melted and cascades such chilled water over the container 14 to provide a cooling effect to the contents of the container. As best illustrates in FIG. 8, the water circulation assembly 80 includes a plurality of drain holes 84 in both the tray 76 and the unlabeled floor of the cavity 78. The chilled water 82 generated by a melting of the ice 74 will pass through the drain holes 84 into a fluid reservoir 86 positioned below the cavity 78 of the container support 12. A battery powered pump 88 is provided to circulate the chilled water 82 through a conduit 90 for dispensing through a pivotally connected spout 92 arranged to cascade the chilled water over the container 14 positioned thereunder. Appropriate conduit arrangements are also provided to direct the cascaded chilled water 82 back into the fluid reservoir 86.

In use, the water circulation assembly 80 effectively recycles the chilled water 82 generated by a melting of the ice 74 to provide a cooling effect to the contents of the container 14. This arrangement is particularly useful when the container supporting and dispensing apparatus 70 is positioned in a heated environment such as outdoor picnics and other events. Because the ice 74 provides the chilled water 82, no other refrigeration apparatus is needed to maintain the contents of the container 14 in a chilled state.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A container supporting and dispensing apparatus for use with a bottle having contents therein, said apparatus comprising:

a container support means for supporting said bottle in a sloped position, said container support means comprising a pair of similarly shaped side walls; a front wall fixedly secured to a front end of said side walls, said front wall having a rectangular aperture formed at a top end of said front wall; a rear wall fixedly secured to a rear end of said side walls; and an arcuately shaped inner wall positioned between said side walls, said inner wall defining a cradle operable to support said bottle in a sloped position;

a valve assembly releasably couplable to said bottle for selectively dispensing said contents from said bottle, said valve assembly comprising a coupling threadably engagable to said bottle; a mount secured to said coupling, said mount having a groove extending therearound; a nozzle coupled to said mount in fluid communication with said bottle; and a valve means coupled to said nozzle for selectively permitting fluid communication through said nozzle, wherein said groove can be slidably engaged to said rectangular aperture to support said valve assembly relative to said front wall;

a pump means coupled to said valve assembly and positioned in fluid communication with said bottle for selectively pressurizing said bottle;

an ice container means coupled to said container support for containing ice, said ice container means comprising a cavity positioned below said cradle; and a tray slidably positioned within said cavity; and, a water circulation means for collecting water generated by a melting of said ice and cascading said water over said bottle.

2. The container supporting and dispensing apparatus as recited in claim 1, wherein said water circulation means comprises a fluid reservoir positioned below said cavity; drain means coupled to said tray for draining said water from said tray to said fluid reservoir; pump means in fluid communication with said fluid reservoir; a conduit in fluid communication with said pump means, said conduit extending from said pump means to a position above said bottle, whereby said water can be pumped by said pump means through said conduit and cascaded over said bottle to provide a cooling effect to said contents of said bottle.

* * * * *